United States Patent [19]

Gnagnetti

[11] 4,456,442

[45] Jun. 26, 1984

[54] ROTARY EXPANSIBLE CHAMBER DEVICE WITH ECCENTRIC ROTOR ASSEMBLY INCLUDING A FLEXIBLE BAND

[76] Inventor: Romano Gnagnetti, Strada Trasimeno Ovest, 283, 06100 Perugia-Olmo, Italy

[21] Appl. No.: 270,688

[22] Filed: Jun. 4, 1981

[51] Int. Cl.[3] ..... F01C 5/06; F03C 2/00

[52] U.S. Cl. ..... 418/153; 418/156; 418/164

[58] Field of Search ..... 418/45, 153, 156, 164, 418/172

[56] References Cited

U.S. PATENT DOCUMENTS

| | | | |
|---|---|---|---|
| 1,086,488 | 2/1914 | Wachter | 418/156 |
| 2,339,017 | 1/1944 | Kritzer | 418/156 |
| 2,677,329 | 5/1954 | Owen | 418/153 |
| 2,882,830 | 4/1959 | McDuffie | 418/164 |
| 3,544,243 | 12/1970 | Stageberg | 418/156 |

FOREIGN PATENT DOCUMENTS

| | | | |
|---|---|---|---|
| 2458541 | 6/1976 | Fed. Rep. of Germany | 418/153 |
| 2510557 | 9/1976 | Fed. Rep. of Germany | 418/153 |

*Primary Examiner*—John J. Vrablik

*Attorney, Agent, or Firm*—Beveridge, DeGrandi & Kline

[57] ABSTRACT

A pump consisting in a rotor (3) realized like a housing, placed in an outer housing (2), inside the rotor a cylindrical element (6) coaxially connected thereto by means of an elastic band (23) forming lobate chambers (13,14) between the rotor and the cylindrical element (6). Inside the cylindrical element (6) a solid cylindrical element (9) with a head (10) flared in the shape of a hexagon is rotating inserted, said cylindrical element (9) engaging with an hexagonal pin (11) fixed in an eccentric position on the closing part (12) of the pump. Thus an eccentric rotation of the cylindrical element (6) is caused and, consequently, the compression and the expansion of the chambers for the expulsion and the suction of the liquid (FIG. 1).

7 Claims, 5 Drawing Figures

ROTARY EXPANSIBLE CHAMBER DEVICE WITH ECCENTRIC ROTOR ASSEMBLY INCLUDING A FLEXIBLE BAND

The present invention concerns a pump consisting in a rotor realized like a housing, placed in an outer housing, and inside said rotor a cylindrical element (sleeve) is provided being coaxially connected to said rotor by means of an elastic band forming lobate chambers between the rotor and the sleeve, inside said sleeve being inserted, freely rotating, a solid cylindrical element which, being engaged with a pin fixed in an eccentric position and placed on the closing part of the pump, causes an eccentric rotation of the sleeve and, consequently, the compression and the expansion of the chambers for the expulsion and the suction of the liquid.

It is already known that, until now, pumps of different kinds have been used according to the specific field of appliance, as e.g. the density of the means to be pumped, the presence of bodies in suspension in the same means—which always cause a very strong wear if not even breaking of the inner mechanical parts—the necessity of keeping the organolectic features of the means to be pumped unaltered.

Even if referring to homogeneous means to be pumped, it was further indispensible to choose a specific kind of pump relating to the number of turns of the same as well as to the delivery capacity of the same. Furthermore, the conventional kind of pumps are never, as it is well known, reversible, as such working would practically annul the efficiency thereof.

It is evident that this meant a considerable investment for the purchase of differrent pumps due to the notable wear of many pumps and which therefore must be completely replaced. Further, also the high number of turns must be considered, which was a reason more for a rapid wear of said pumps. Therefore, pumps with radial impellers, with centrifugal impellers or gear pumps were to be used, according to the different density of the means to be pumped.

The principle of the exploitation of the eccentricity in pumps is already known. For example, the GB No. 533,895 and the DE-AN M No. 20368 XI/81e both concern pumps with eccentric effect. But in both many mechanical elements are provided which will deformate an elastic chamber-like element. Furthermore, the DE-AN M No. 20368 XI/81e bases on the principle of the rotating piston pump. The mechanism of the pumps described in the cited documents is rather complicated and the mechanical elements do easily and anyhow wear and break, which makes the pump very expensive and little reliable.

Therefore, it is the aim of the present invention to realize a pump of low cost and which serves, at the same time, for the pumping of a means of any density, without altering the organolectic features thereof, even if containing bodies in suspension, and the wear of said pump being limited to the sole operative parts which can be easily substituted without removing the whole of the pump, and in which no mechanical element is needed for modifying the shape of an elastic, chamber-like element, but said element is the one who is subject to the necessary deformations due to the sole eccentric movement of the rotor.

This aim is reached realizing a pump wherein the chambers consist in a continuous elastic band which, being fixed alternatively and coil-like to a cylindrical housing (rotor) and to a coaxial cylindrical element, is placed in the free room between the inner wall of the rotor and the coaxial cylindrical element axially crossing said free room, the width of the band and the length of the cylindrical element being equal to the depth of the cylindrical cavity of the rotor.

The main principle of the present invention therefore consists in the direct connection, by means of the coil-like band, between the rotor and the cylindrical element which determined the eccentric movement, as will be better described hereinbelow. In fact, the compression and the expansion of the chambers, respectively in the points of maximum and minimum excentricity, said points being diametrically exposed, takes place without any intermediate mechanical means. The compression and the expansion of the chambers and, therefore, the expulsion and the suction of the liquid are thus obtained in the most easy and inexpensive way.

According to the present invention, the volumes comprised between the respective chambers, are equal. This allows a greater balance when working, i.e. during the suction and the expulsion of the means to be pumped, as well as a complete exploitation of the volume of the body of the turning part.

Still according to the present invention, a first cylindrical body shows, at the centre thereof, an hexagonal flaring in which a hexagonal pin engages, said pin being unitary with the closing part of the pump and eccentrically placed with respect to the geometrical centre thereof. Further, the closing part of the pump shows two cavities in the shape of circular sectors, placed diametrically opposite one to the other and ending up into two tubes for the input and the output of the means being pumped.

According to the present invention, the closing part of the pump will be applied to the body containing the rotor by introducing the hexagonal pin, eccentrically projecting and out of one piece with the surface of said part, into the hexagonal flaring produced in the first said cylindrical body, putting near the two parts forming the body of the pump and applying around said parts a hinge-jaw wrapping up the outer surfaces of the contact parts with the parts thereof. Said hinge-jaw is provided, at one of the free ends thereof, with a U-shaped bracket and, at the other end, with a threaded eye. In said U-shaped bracket a thumbscrew is inserted which will be screwed in said threaded eye thus tightening the jaw and blocking the two parts of the pump in a geometrical coupling.

Putting near said parts one to the other, the two outer contact surfaces thereof will not be found lined up due to the eccentric position of the projecting pin. But when tightening the thumbscrew, the hexagonal pin of the closing part being penetrated into the hexagonal flaring of said first solid cylindrical element, will force the whole, consisting in the first said solid cylindrical element (sleeve) and the applied coil-like band to place in an eccentric position.

It must be added that the pump thus realized works also in the opposite way maintaining the efficiency perfectly steady. Furthermore, the pump becomes self-aspirating at 150–200 turns per minute due to the strong aspiration of the same at that number of turns, and thus even being that number much below the number of turns needed for specific self-aspirating pumps (2,900 turns per minute).

Finally, still according to the present invention, and due to the very low number of turns (from 50 to 300 turns per minute) the pumped means does not suffer any alteration and therefore keeps all the specific features thereof.

The advantages obtained with the pump according to the present invention consist mainly in the simplicity thereof due to the lack of any mechanical element for the deformation of the elastic coil-like band. The pump can further be used for any operation without the need of specific pumps. Infact, the conventionally used pumps can be divided into four kinds:

(A)—pumps for clear or muddy waters, and with bodies in suspension;

(B)—specific pumps (milk, wine, oil, salt water);

(C)—pumps for foodstuffs (thick liquids, olive husk, alimentary doughs, confectionary industries);

(D)—pumps for chemical, oil or pharmaceutical industries (acids, solvents, fuel, alcohols).

The pump according to the present invention can be used in any of said fields of use and further guarantees, for over 90% of the cases, a considerable convenience for what concerns wear, purchase and maintenance costs. Finally, said pump is reversible with exactly the same efficiency.

The object of the present invention will be now described relating to a preferred embodiment shown in the enclosed drawings, in which.

Figure 1:
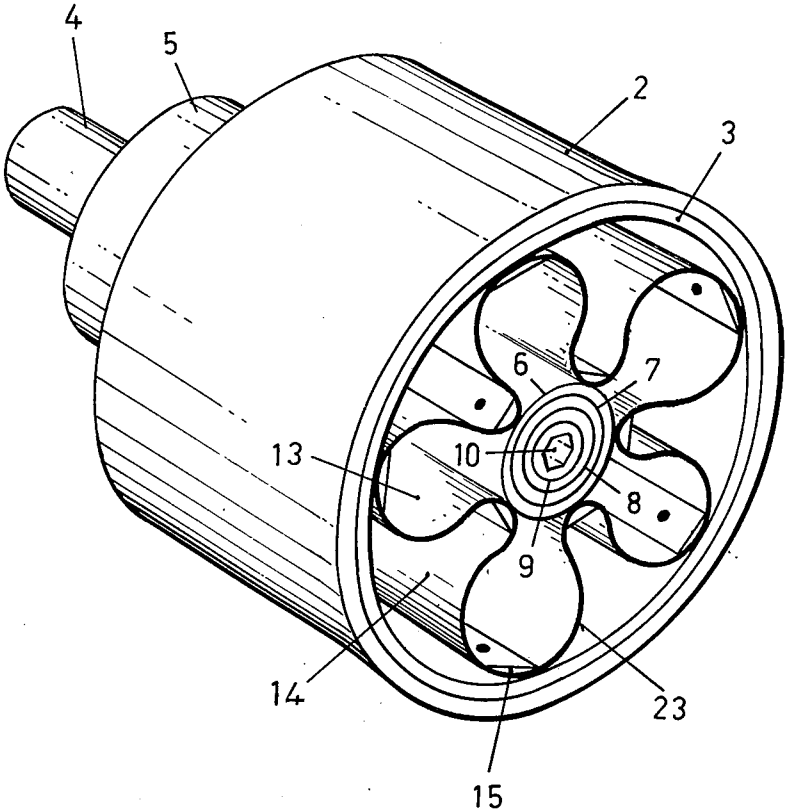

FIG. 1 shows that part of the pump containing the body of an impeller, called the second cylindrical housing, out of steel, shown by 2, in which a first cylindrical housing 3 (rotor) out of bronze, is rotatingly placed. On the back thereof a hub 4, integral with cylindrical housing 3, and sleeve 5, integral with housing 2, can be seen. On the front part, the outside of a second cylindrical element 6 can be seen, in which ball bearings (only one thereof being shown in the drawings) are keyed, the inner and outer races thereof being shown by 7 and 8. Finally, the outside of a first solid cylindrical body 9 can be seen, in which a hexagonal flaring 10 is performed, and an hexagonal pin 11, projecting from the closing part of the pump shown by 12 (FIG. 2), will engage therewith. Still in FIG. 1, around cylindrical element 6 a band out of elastic material, preferrably in hard rubber, is applied, forming lobate chambers 13, 14 . . . , fixed along cylindrical body 6 and, respectively, along cylindrical housing 3 by means of axial members or sections 15 being as long as the section of cylindrical body 6 and cylindrical housing 3. These sections are fixed to cylindrical housing 3 and, respectively, to cylindrical body 6. Sections 15 have curved surfaces for engaging the flexible band. It should be noted that cylindrical body 6, rotating around said cylindrical body 9 is, together with the last, independent from the closed bottom of cylindrical hosuing 3 and is supported by the same by means of a band 23 with elastic chambers.

When a stationary hexagonal pin 11 enters an hexagonal flaring or axial recess 10, the whole consisting in cylindrical body 6 and band 23, can eccentrically rotate around cylindrical body 9, thus compressing and extending chambers 13, 14 . . . corresponding to the points of maximum, respectively minimum eccentricity, thus determining in those areas, as already said, the expulsion and respectively the suction of the means to be pumped.

Figure 2:
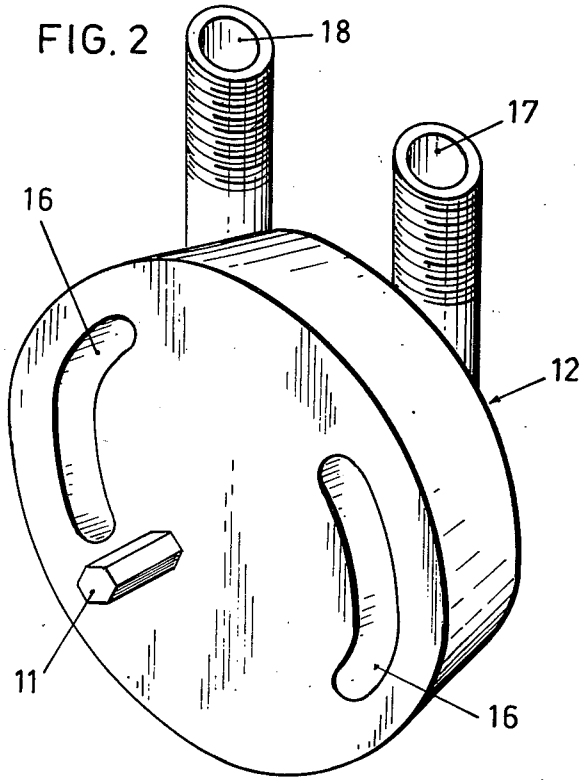
FIGS. 1 and 2 show an axonometric view of the two parts of the pump according to the present invention.

FIG. 2 shows the closing part of the pump. Cavities 16 in the shape of circular sectors are seen, being in direct connection with tubes 18 for the input and the output of the means to be pumped, which will be placed—once the pump is mounted— in perfect correspondence with the extreme eccentrically points for the compression and, respectively, for the expansion of chambers 13, 14 . . . .

Figures 3, 4:
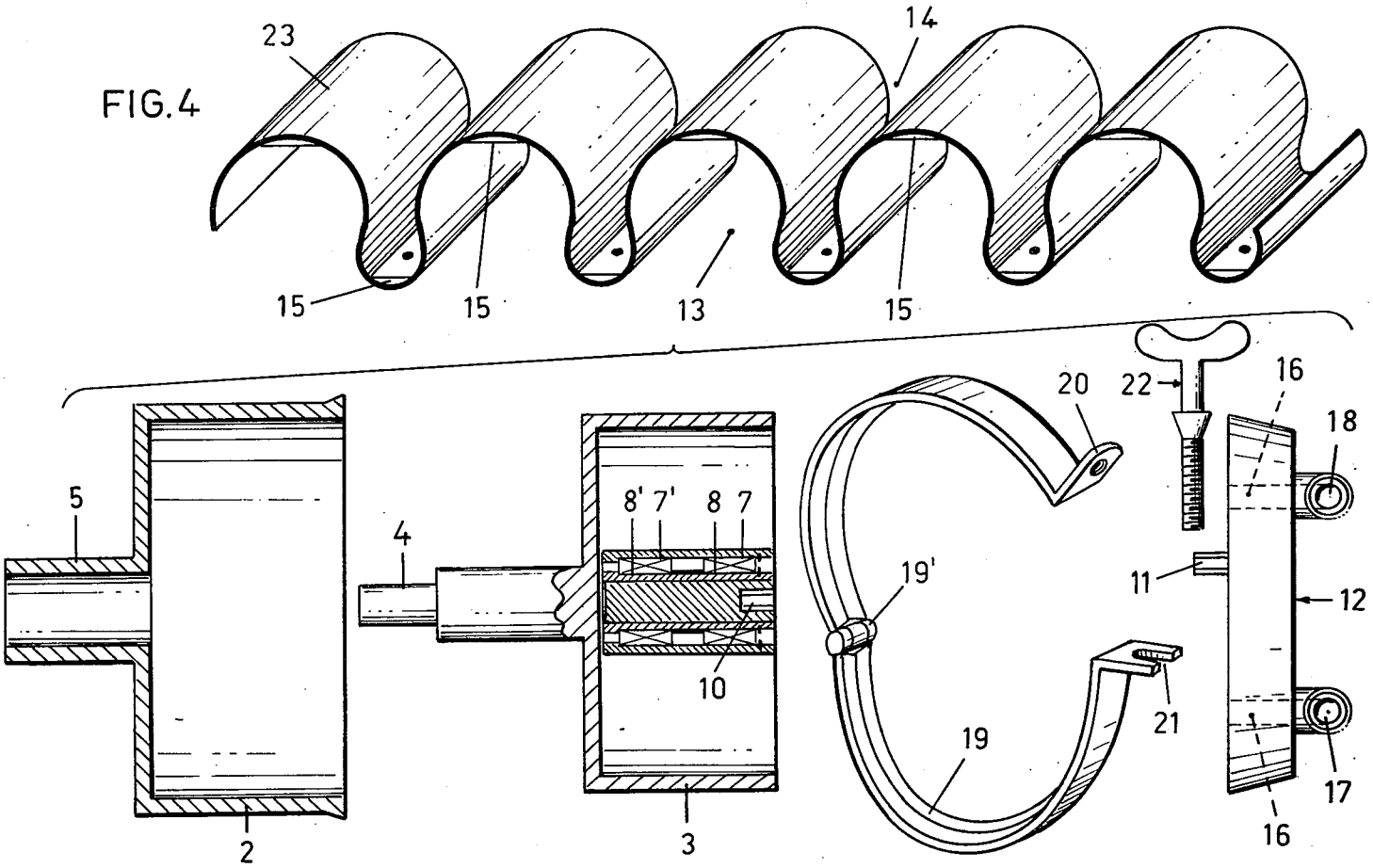
FIG. 3 shows an exploded front view of the elements composing the pump.
FIG. 4 shows an axonometric view of the band with elastic chambers developed in length.

FIG. 3 shows the inner housing 3 (rotor) and outer housing 2. By 4 and 5 a hub, out of one piece with cylindrical housing 3, and a sleeve, out of one piece with outer cylindrical housing 2, are shown. By 7, 8; 7', 8' the outer and inner jackets of two ball bearings are shown, and inside said ball bearings solid cylindrical body 9 with a hexagonal flaring 10 is keyed. Further, a jaw 19 with a hinge 19' provided with a threaded eye 20 and a U-shaped bracket 21 are shown, for the inserting and screwing of a thumbscrew 22. When tightening this screw, the two parts of the body of the pump will be made perfectly connecting, in spite of the eccentric position of hexagonal pin 11 projecting from the surface of the closing part of the pump. Also tubes 17, 18 for the input and the output of the means to be pumped are shown.

FIG. 4 shows band 23 with chambers 13, 14 . . . in an axonometric view and extended in length. Also sections 15 for fixing to cylindrical element 6 and, respectively, to cylindrical housing 3 are shown.

Figure 5:
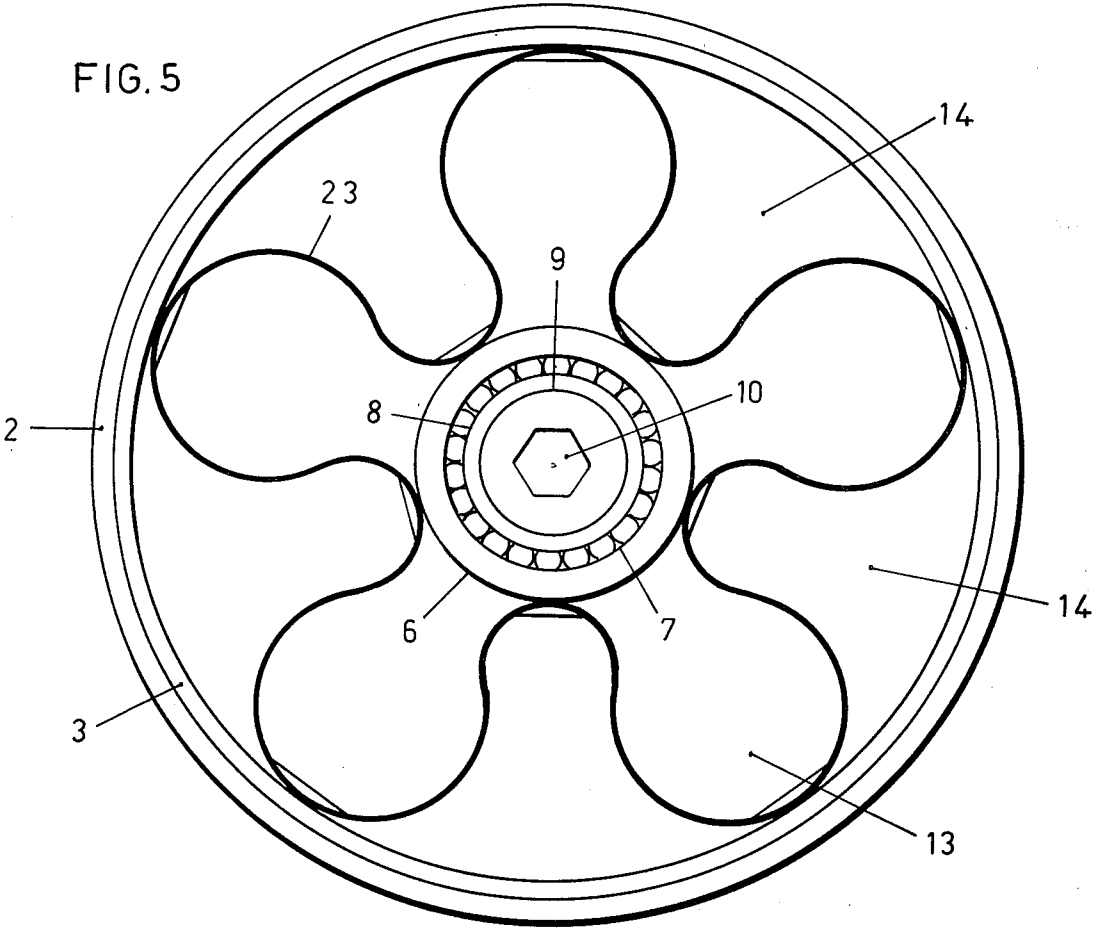
FIG. 5 shows a plan view of the band with elastic chambers placed between the second cylindrical body (sleeve) and the first cylindrical housing (rotor) prior to the assembly step which moves the cylindrical body 9 to an eccentric position.

Finally, FIG. 5 shows a plan view of the disposition of band 23 with chambers 13, 14 prior to the assembly step which moves the cylindrical body 9 to an eccentric position. It should be noted that the surfaces of the chambers are all equal. Also cylindrical body 6, outer jacket 7 and inner jacket 8 of one of the ball bearings, solid cylindrical body 9 and hexagonal flaring 10 can be seen.

The pump according to the present invention works as follows:

the driving shaft (not shown in the drawing) is connected, by means of a motoreducer, in a dynamic coupling to hub 4 integral with inner housing 3 (rotor), out of bronze. The speed does not exceed the 200–300 turns per minute. Inner housing 3 drags chambers 13, 14 . . . formed by the elastic band 23 and, therewith, cylindrical body 6, liable with ball bearings 7, 8; 7', 8' rotating around cylindrical body 9 with flared hexagonal head. Said head being engaged with pin 11 of closing part 12 of the pump and being placed in an eccentric position, forces the whole consisting in cylindrical body 6 and band 23 with chambers 13, 14 . . . , to eccentrically rotate around cylindrical body 9, so that chambers 13, 14 . . . will be alternatively found in the position of minimum, respectively maximum eccentricity, corresponding to outlet tube 18 and inlet tube 17 of the pump. The chambers that in turn approach the position of minimum eccentricity are compressed and, therefore, an expulsion of the means to be pumped through tube 18 takes place. It is evident that there will be some chambers which, during the rotation, will be found in intermediate positions between those near to the two points of minimum and maximum eccentricity. Said chambers will keep the volume thereof steady in these rotation movements. The number of the chambers depends obviously on the dimension of the pump, but the principle remains unvaried. It is also evident that the penetration power of the impeller of any solid body is considerably deadened by the elasticity of the chambers and that therefore it is nearly impossible for the impeller to break.

It is also evident that the shape of the impeller allows the pump to operate on a means of any thickness, since said means will be kept by the elastic chambers in the suction and in the expulsion stage. Also the reversibility of the functions of the pump due to the presence of the chambers, is evident. Finally, it can be seen how, due to the very low number of turns per minute, the means to be pumped can not suffer any alteration of the specific and organolectic features thereof.

It is obviously possible to apply many variations for what concerns the disposition, the proportions and the dimensions, without therefore going out of the limits of the present invention.

What I claim is:

1. A rotary expansible chamber device, comprising, an outer housing, a rotor assembly which includes a cylindrical rotor body, a flexible band and a cylindrical inner member, said cylindrical rotor body being located in said housing and being rotatable about a rotor axis which is concentric with respect to said outer housing, said cylindrical inner member of the rotor assembly being located within and spaced from the rotor body, said flexible band connecting the inner member to the rotor body and being provided with spaced portions of opposite curvature so that it forms a set of circumferentially spaced lobate chambers which are located between the rotor body and the inner member of the rotor, said flexible band being affixed at longitudinally spaced locations to the interior of said cylindrical rotor body and to the exterior of said cylindrical inner member, means for supporting the inner cylindrical member for rotational movement about an axis which is eccentric with respect to the rotor axis whereby rotation of the rotor assembly will produce expansion and contraction of said chambers, said housing having circumferentially spaced inlet and outlet openings in communication with the lobate chambers formed by said flexible band.

2. A rotary expansible chamber device according to claim 1 having a plurality of axial members for affixing the flexible band to the cylindrical rotor body and to the cylindrical inner member, each of said axial members having a curved surface engaging the flexible band.

3. A rotary expansible chamber device according to claim 2 wherein said means for supporting the inner cylindrical member of the rotor includes a stationary support member.

4. A rotary expansible chamber device according to claim 1 wherein said means for supporting the inner cylindrical member of the rotor includes a stationary support member.

5. A rotary expansible chamber device according to claim 4 wherein the stationary support member has an axial recess, and the outer housing has a pin which is received in the axial recess of the stationary support member.

6. A rotary expansible chamber device according to claim 5 wherein the axial recess of the stationary support member has a cross-section which prevents rotation of the stationary support member on the pin.

7. A rotary expansible chamber device according to claim 6 wherein the axial recess of the stationary support member and the pin have hexagonal cross-sections which prevent rotation of the stationary support member on the pin.

* * * * *